United States Patent [19]

Vanderpool et al.

[11] 4,278,463

[45] Jul. 14, 1981

[54] PROCESS FOR RECOVERING COBALT

[75] Inventors: Clarence D. Vanderpool; Martin B. MacInnis, both of Towanda; Robert P. McClintic, Monroeton; Richard G. W. Gingerich, Towanda, all of Pa.

[73] Assignee: GTE Products Corporation, Stamford, Conn.

[21] Appl. No.: 135,050

[22] Filed: Mar. 28, 1980

[51] Int. Cl.[3] ..... C22B 23/04

[52] U.S. Cl. ..... 75/0.5 A; 75/109; 75/119; 423/140; 423/143; 423/463

[58] Field of Search ..... 75/0.5 A, 0.5 AA, 0.5 BA, 75/109, 119; 423/140, 143, 463

[56] References Cited

U.S. PATENT DOCUMENTS

| | | | |
|---|---|---|---|
| 1,963,893 | 6/1934 | Drouilly | 75/109 |
| 2,879,137 | 3/1959 | Bare et al. | 75/119 X |
| 3,579,327 | 5/1971 | Hasegawa et al. | 75/109 |
| 3,810,967 | 5/1974 | Takasu et al. | 423/139 |
| 3,928,530 | 12/1975 | Bakker et al. | 75/103 X |
| 4,108,640 | 8/1978 | Wallace et al. | 423/145 X |
| 4,184,868 | 1/1980 | Ritsko et al. | 75/108 X |

FOREIGN PATENT DOCUMENTS

| | | |
|---|---|---|
| 1583864 | 2/1972 | Fed. Rep. of Germany . |
| 2319703 | 10/1973 | Fed. Rep. of Germany . |

*Primary Examiner*—G. Ozaki

*Attorney, Agent, or Firm*—Robert E. Walter

[57] ABSTRACT

Cobalt is recovered from byproduct streams from a basic process by contacting the byproduct streams with aluminum metal for a sufficient period of time to produce cobalt metal as a precipitate. The basic process is the type wherein cobalt ions in solution are complexed with ammonia in the presence of halide ions to form an ammine halide solution from which a cobalt containing precipitate is separated. The precipitate is subsequently reduced to form a cobalt metal powder.

4 Claims, No Drawings

PROCESS FOR RECOVERING COBALT

CROSS REFERENCE TO RELATED APPLICATIONS:

Copending U.S. patent application Ser. No. 010,769, filed Feb. 9, 1979 now U.S. Pat. No. 4,184,868 to Ritsko et al, a continuation of Ser. No. 911,595, now abandoned, describes a method for obtaining fine particle size cobalt by hydrogen reduction of a precipitate obtained from a cobalt pentammine chloride solution. The copending applications relating to the production of fine metal cobalt include Ser. No. 038,973, now U.S. Pat. No. 4,214,896 to Cheresnowsky, relating to mother liquor treatment, Ser. No. 038,968, now U.S. Pat. No. 4,214,894 to Ritsko et al., utilizing an ion exchange resin during cobalt liquor processing, Ser. No. 038,971, now U.S. Pat. No. 4,214,894 to Gingerich, relating to the use of a metallic hydroxide to form a cobalt containing precipitate, Ser. No. 038,970, now U.S. Pat. No. 4,218,240 to Ginerich et al, relating to a method for producing cobaltic hexammine compounds and cobalt metal powder therefrom, and Ser. No. 038,972, now U.S. Pat. No. 4,233,063 to Rtisko et al, relating to recovery of cobalt from byproduct streams from a basic process.

TECHNICAL FIELD

This invention relates to an improved method for obtaining cobalt from aqueous solutions which are byproduct streams from a basic cobalt production process.

BACKGROUND

U.S. Pat. No. 3,579,327 relates to a process wherein zinc dust containing a small amount of antimony or antimony and lead as alloy element is added into an electrolyte in hydrometallurgy of zinc to remove cobalt impurities from the electrolyte of zinc sulfate solution.

U.S. Pat. No. 3,810,967 to Takasu discloses a process for recovering cobalt from an oxo reaction product wherein the cobalt is converted into a water soluble iron salt of carbonized cobaltate.

U.S. Pat. No. 4,093,450 to Doyle et al. describes a method for producing fine particle size cobalt metal powder by the hydrogen reduction of cobalt oxide obtained from a cobalt pentammine carbonate solution. The precipitate is formed by heating the solution to drive off ammonia and carbon dioxide to form a precipitate of cobalt oxide. This method requires a solution of approximately 4 grams per liter of cobalt to produce a size metal powder having a particle size less than one micron. Note that the final resulting particle size is highly dependent on the concentration of cobalt employed in the aqueous solution.

U.S. Pat. No. 2,879,137 to Bare et al. discloses the treatment of ammoniacal ammonium carbonate solution, obtained from leaching and/or containing nickel wherein the cobalt present in the cobaltic state is treated with an alkali metal or alkaline earth metal hydroxide under controlled temperature conditions to precipitate the nickel free of cobalt.

U.S. Pat. No. 3,928,530 to Bakker et al. discloses a method for the separation of nickel and cobalt by forming pentammine chloride complexes and solution containing a high concentration of ammonium chloride, and precipitating cobalt pentammine chloride.

In German Pat. No. 1,583,864, cobalt is recovered from scrap by digestion of the scrap in hydrochloric acid and magnesium chloride solution, followed by removal of iron and chromium impurities by precipitation at moderately acid pH followed by extracting a cobalt chloride complex with a long chain tertiary amine in an aromatic solvent.

U.S. Pat. No. 4,108,640 to Wallace discloses a method for recovering metallic cobalt from an aqueous ammonical solution wherein the solution is contacted with a water immiscible liquid ion exchange reagent dissolved in an inert organic diluent to selectively extract the other metal from the solution and produce an organic extract loaded with the other metals and an aqueous cobalt bearing raffinate substantially free of the other metals.

DISCLOSURE OF THE INVENTION

In accordance with the present invention, there is provided an improvement in a basic cobalt production process of the type comprising the steps of digesting a cobalt source to form cobalt ions in solution, complexing said cobalt ions with ammonia in the presence of halide ions to form a cobalt ammine halide solution, forming a cobalt containing precipitate, separating said cobalt containing precipitate from the resulting solution, wherein the improvement comprises contacting the resulting solution at an acid pH with a sufficient amount of aluminum metal for a sufficient period of time to form cobalt metal as a precipitate.

The process of the present invention is effective in removing soluble cobalt values in byproduct streams so as to increase the effectiveness and efficiency of the overall process.

DETAILED DESCRIPTION

The method for producing fine particle size cobalt metal powder, herein referred to as the "basic" method, of which the present invention is an improvement, as described and claimed in copending patent application Ser. No. 010,769, filed Feb. 9, 1979, now U.S. Pat. No. 4,184,868 to Ritsko et al, and assigned to the present assignee.

Aqueous solutions containing cobalt from a variety of sources may be utilized in the method of the present invention. Such solutions may be derived from sludges and leach solutions from cemented carbide or tungsten recovery operations which may result from the digestion of scrap and impure powders. Typical leach solutions are obtained from leached oxidic materials, such as ores, oxidized sulfite concentrates, hydroxide concentrates and the like. The starting solutions may contain a variety of anions and cations such as iron, manganese, copper, aluminum, chromium, magnesium, nickel, calcium, sodium, potassium, etc. It is contemplated that the cobalt ion containing starting solution may be formed from byproduct streams from various hydrometallurgical processes.

The digested cobalt source comprising an aqueous solution containing cobalt ions are complexed with ammonia in the presence of halide ions to form a cobalt ammine halide solution. The basic process is not limited by cobalt ion concentration so that the original solution containing the digested cobalt source may have a cobalt concentration up to 60 or even up to 150 grams per liter of cobalt. To complex cobalt ions with ammonia to form an aqueous cobalt ammine halide solution, ammonia and halide ions are present in solution from any convenient source. Ammonia may be present or formed in a variety of ways such as bubbling ammonia gas through the solution or adding ammonium hydroxide directly thereto. The halide ions may be present such as would occur if the original cobalt source is digested by hydrochloric acid or if a halide salt or acid halide is added to the solution.

It is desirable to oxidize cobalt ions present in the divalent state in the starting solution to the trivalent state. Conventional oxidation methods may be utilized. The solution containing cobalt ions, halide ions and ammonia may be contacted with a gas containing oxygen such as by aeration for a sufficient period of time to substantially convert the cobalt ions to the trivalent state. Other oxidizing methods may be used.

Oxidation of a cobaltous ion to cobaltic ion results in the formation of cobaltic ammine ions in the solution containing cobalt ammonium and halide ions. At least a portion of the cobaltic ammine ions are preferably present in the form of cobaltic hexammine or halocobaltic pentammine having the formula $Co(NH_3)_{6-a}X_3$ wherein X is a halogen and a is 1 or 0.

In accordance with the preferred basic process, the cobalt source is digested in hydrochloric acid solution to obtain solution of about 60 to 150 grams per liter of cobalt in a 1 to 6 molar hydrochloric acid solution having a pH of about 0.1 to 1.5. Ammonium hydroxide is added to result in a concentration of about 100 to 150 grams per liter of ammonia chloride at a pH of about 8.5 to 10.0. Air oxidation of the cobaltous ion to cobaltic ions results in the formation of cobaltic ammine ions. Typical oxidation times are from about 1 to about 10 hours. The solution is also preferably heated to a moderate temperature, for example, about 40° to 80° C., in order to dissolve substantially all the cobalt ammine chloride.

Cobalt metal powder may then be obtained from the cobalt ammine halide solution by digesting the solution for about 2 to 10 hours at a temperature of about 80° C. to 105° C. to decompose the cobalt ammine halide and form a cobalt containing precipitate. From an initial starting basic pH, the pH of the solution decreases during the digesting process. The cobalt-containing precipitate is separated from the resulting solution and the precipitate is heated in a reducing atmosphere for a time and temperature sufficient to reduce the precipitate to cobalt metal powder.

The purity of the resulting metallic cobalt powders is dependent on the purity of the starting solution and certain metallic cations which may be regarded as impurities may precipitate with the cobalt and may be present in the final reduced cobalt metallic powder. Depending on the composition of the cobalt source and the purity desired for the final cobalt metal powder, several additional steps may be carried out.

For example, after the initial digestion of the cobalt source and prior to the addition of ammonia, it may be necessary to remove insoluble sludge, typically containing tantalum, titanium and tungsten from cobalt sources. The scrap or sludge sources from cemented carbide industry may contain significant amounts of insolubles. Separation of precipitates or sludges from solutions of any of the above or subsequent steps may be accomplished by filtering followed by washing the filtrate.

To remove cation impurities, the basic process may further include acidifying the cobalt ammine halide solution to form a precipitate comprising cobalt ammine halide and separating the purified cobalt ammine halide precipitate from the resulting solution containing impurities. Preferably the acidification step is carried out by adding hydrochloric acid to the solution containing cobalt ammine chlorides.

The above described purified cobalt ammine halide precipitate is separated from the solution containing impurities and dissolved in an ammonia containing solution. At this stage, it may again be desirable to remove insoluble sludge. Cation impurities other than iron in the solution are typically present in the range of about 100 parts per million to 1 weight percent at this step of the process. Iron will usually be less than 1,000 parts per million. Cationic impurities of less than 100 parts per million may be achieved by one or more optional "recrystallization" (i.e. acid precipitation followed by ammonia dissolution) of the cobalt ammine halide prior to digestion to form the cobaltcontaining precipitate.

The cobalt containing precipitate formed from relatively pure cobalt ammine halide solutions as described above has a black coloration. It is believed to be an amorphous hydrated cobaltic compound. Although it is difficult to measure particle size of the precipitate, it appears that the particles are from about 10 to about 25 microns in size. Air drying the cobalt containing precipitate at a temperature of about 100° C. results in the formation of particles having an averge particle size from about 2 to about 5 microns. These latter particles appear to be a hydrated cobaltic oxide having the formula $Co_2O_3.1H_2O$. Reduction of the wet and undried precipitate is typically carried out in a hydrogen atmosphere for a time of from about 1 to 6 hours at a temperature within the range of about 350° C. to 600° C.

In the above-described method, mother liquor from the acid precipitation steps and the digestion step producing the cobalt containing precipitate contain various cobalt species in solution. Such species include cobalt ammine chloride due to incomplete conversion of the soluble cobalt ammine chloride to the cobalt containing precipitate. Other cobaltous and cobaltic species may be present. The mother liquor may typically contain up to 10 grams cobalt per liter. Generally, the basic process is effective in reducing the soluble cobalt concentration to less than about 3 grams of cobalt per liter.

Accordingly, the present invention is an improvement of the above-described basic method wherein mother liquor from the second digestion step and any acid precipitation steps which contain a relatively small concentration of soluble cobalt is treated to convert soluble cobalt ions in the mother liquor to metallic cobalt precipitate. The precipitate, depending on the purity is in the form of usable cobalt metal powder or recycled by adding it to the cobalt source for repetition of the basic method.

In accordance with the improvement of the present invention, the resulting solution remaining after the formation of the cobalt containing precipitate is contacted with a sufficient amount of aluminum metal for a sufficient period of time to form cobalt metal as a precipitate. The mother liquors remaining after the formation and separation of any precipitated cobalt ammine halide and any reprecipitated cobalt ammine halide may be individually or together combined with the resulting solution remaining after the formation of the cobalt containing precipitate and processed to remove metallic cobalt as a precipitate.

The above described aqueous cobalt containing solutions are by-product streams of the basic process and individually or collectively form a reclaim solution from which cobalt is recovered via the secondary recovery process of the present invention.

The by-product or reclaim solutions as above described from the basic process are typically at a pH of from about 0.5 to about 1.0. The process of the present invention is operably at pH's less than or equal to 7.0. Higher pH requires heating the reclaim solution to promote the reaction. Generally, a higher yield of cobalt as a precipitate is obtained at higher pH. At lower pH, the aluminum is consumed rapidly with the formation of aluminum hydroxide as a coprecipitate. The pH of the byproduct solutions may be varied within a wide range by adding an acid or a base to obtain the desired effect.

The aluminum added may be in the form of scrap aluminum such as found in cans or other aluminum containers. It has been discovered that for the process of the present invention to be operable, the mother liquors should contain various other cations in addition to cobalt. When aluminum is added separately to solutions of cobaltic pentammine halide, cobaltic hexammine or cobalt dichloride, metallic cobalt does not precipitate. Typical other cations which appear to promote the formation of cobalt precipitate include iron, copper and manganese and ammonium ion.

The amount of aluminum used does not appear to be critical provided a sufficient amount is added to the byproduct solution to result in the precipitation of metallic cobalt. Generally, the molar amount of aluminum added is from about 50 to about 100 percent of the molar amount of cobalt present in solution.

The following examples will further illustrate the specific embodiments of this inventin. It should be understood, however, that these examples are given by way of illustration and not limitation. All temperatures are in degrees C and all parts are by weight, unless otherwise indicated.

EXAMPLE I

Cobalt Chloride Solution To Crude Cobalt Pentammine Chloride

One hundred milliliters of a cobalt chloride solution obtained by the digestion of scrap tungsten carbide in hydrochloric acid is diluted with deionized water to a specific gravity of 1.25 and a pH of 0° to 22° C., resulting in a concentration of about 115 parts by weight of cobalt chloride per liter. Ammonia hydroxide is then added to lower the specific gravity to about 1.038 and to raise the pH to about 9.3 at 50° C., resulting in about 240 milliliters of solution. The solution is then aerated at an air flow rate of about 5 cubic feet per hour for 2 to 8 hours. The oxidized solution is then heated to 90° C. and held for 15 minutes at this temperature after which 56 milliliters of hydrochloric acid are added to lower the pH to about 0.5. The solution is then digested at 80° to 90° C. for one hour. Agitation is continued throughout digestion. The digested solution is cooled to about 40° C. at which temperature the cooling water is removed, agitation is stopped and the precipitate is allowed to settle. A portion of the mother liquor is then decanted. The remaining mother liquor is then filtered to remove the precipitate and the filtered mother liquor is recombined with the decanted mother liquor.

Preparation Of Pure Cobalt Pentammine Chloride

About 50 parts by weight of precipitate are obtained in the form of crude cobalt pentammine chloride. About 17 parts by weight of this crude cobalt pentammine chloride is then charged to 195 milliliters of deionized water at about 60° C. and with agitation. Ammonia hydroxide is added to achieve a pH of about 10 at 30° C. Continuing agitation, the slurry is then heated to about 65° C. until the crude pentammine chloride has dissolved, resulting in a solution having a pH of 9.1 and a specific gravity of 1.008 at 60° C. The solution is then filtered. About 30 percent hydrochloric acid is added to the filtrate to achieve 265 milliliters of solution having a pH of about 0.5 at 80° C. The solution is digested for one to two hours with agitation, then cooled to about 25° to 35° C. The precipitate is allowed to settle and a portion of the mother liquor is decanted. The remaining mother liquor is filtered to remove about 16.5 parts by weight of pure crystalline cobalt pentammine chloride.

Pure Cobalt Pentammine Chloride To Cobalt Precipitate

About 17 parts by weight of pure cobalt pentammine chloride are added with agitation to 185 milliliters of deionized water at about 60° C. With agitation, ammonium hydroxide is added to achieve a pH of 10.0 at 30° C. The solution is then agitated and heated to a temperature of 60° C. to dissolve the pure cobalt pentammine chloride. The resulting solution has a pH of 9.3 and a specific gravity of about 1.008 at 60° C. The solutiion is then filtered at about 40° C. and then heated to about 90° C. and digested at this temperature for six hours. The volume is maintained during digestion by the addition of deionized water. At the end of digestion, the pH is about 6.0 to about 7.5 at 80° C. The cobalt precipitate is allowed to settle and a portion of the mother liquor is decanted. The slurry remaining in the tank is washed to remove chloride by adding 140 milliters of hot deionized water and 1½ milliliters of ammonium hydroxide and agitating for about 5 minutes after the slurry has been heated to about 80° C. The cobalt precipitate settles, and is then removed by filtration. The cobalt precipitate is then reslurried in 70 milliters of hot deionized water, again allowed to settle and the mother liquor decanted. Filtering is again carried out.

Cobalt Precipitate To Cobalt Metal Powder

The wet cobalt precipitate is reduced to cobalt metal powder by loading 200 gram batches in refractory boats and stoking the boats into and out of a hydrogen reduction furnace at 300° to 600° C. at a rate of ten minutes per boat, resulting in a total reduction time of about 1½ hours per boat.

Reclamation Of Cobalt In Byproduct Streams

The byproduct streams from the above mentioned process steps are collected in a 2 liter beaker. About 200 milliliters are collected as a filtrate and decanted mother liquor from the preparation of crude cobalt pentammine chloride. About another 250 milliters are collected as filtrate from the formation of the pure cobalt pentammine chloride. An additional 220 milliters are collected from the digestion step which results in the formation of the wet cobalt precipitate as hereinbefore described and approximately about 140 milliters of wash liquors are also added to the mixing tank equipped with a stirrer to give about 900 milliters of a reclaim solution containing about 1.5 percent by weight ammonia.

EXAMPLE 2

The mother liquor resulting from the preparation of crude cobalt pentammine is at a pH of about 0.5 and contains about 7.3 parts by weight of cobalt per liter. Separate 100 part allotments are adjusted to the following respective pH values by the addition of sodium hydroxide. About 5 parts by weight aluminum is added to each allotment. It was observed that hydrogen gas is produced and the color of the solution changes from a yellow-brown color to a pink color and a black precipitate results. In the allotment having a starting pH of 7, the black precipitate is mixed with a thick pink gel. The precipitate was separated by filtration and the filtrate was analyzed as having the following cobalt concentration for the respective various starting pH values. At pH of 3.0 and 6, the cobalt concentration was one part per 1,000 parts of filtrate. At pH of 7, the cobalt concentration was 0.41 parts of cobalt per 1,000 parts of filtrate.

EXAMPLE 3

The combined reclaim solution as described in Example 1 was analyzed having the composition in weight percent: 1.5 percent ammonia; 0.29 percent cobalt; 1.7 percent iron; 12 parts per million copper, and 6 parts per million manganese. About 2 parts aluminum powder was added to the solution which is at a pH of about 1.0 and the solution is heated to about 55° C. After the evolution of hydrogen stopped, the black precipitate was separated and the filtrate was analyzed as containing about 0.08 percent by weight.

EXAMPLE 4

Cobalt Chloride Solution To Crude Hexamminecobalt(III)Chloride

To a 2000 milliliter beaker that was equipped with a 2.5 inch magnetic stirring bar were successively added 250 milliliters of aqueous ammonium hydroxide (28% by wt.), 200 milliliters of aqueous cobalt chloride solution which was obtained by the digestion of scrap tungsten carbide in hydrochloric acid (120 grams of cobalt per liter), and 4.9 grams of activated charcoal. The resultant mixture that had a pH value of 9.7 was maintained at a temperature of 20° C. and stirred for 7 hours with a stream of air bubbling through the mixture. Successively, the consequent suspension was treated with 250 mls of aqueous hydrochloric acid (36% by wt.), cooled to 3° C. in an ice bath, and filtered on a funnel. A mixture of insoluble yellow hexamminecobalt(III) chloride and charcoal was obtained after a wash of 120 mls. of 6 molar hydrochloric acid had been applied to the solids in the funnel.

Preparation Of Pure Hexamminecobalt (III) Chloride

The mixture of crude hexamminecobalt(III) chloride and charcoal was added to 500 mls of water in a 2 liter beaker, and the pH value of the resultant mixture was adjusted to 7.0 with sodium hydroxide. After heating the suspension to 45° C. with stirring, it was filtered on a funnel to remove charcoal, iron, aluminum and other insoluble materials. The filtrate containing 24 gms of cobalt per liter was successively treated with 550 mls of aqueous hydrochloric acid (36% by wt.), cooled to 5° C. in an ice bath, and filtered on a funnel. Washing the resultant insoluble hexamminecobalt(III) chloride with 100 mls of 6 M hydrochloric acid gave a 98% yield of pure hexamminecobalt(III) chloride.

Hexamminecobalt(III) Chloride To Cobalt Oxide Hydrate

Pure hexamminecobalt(III) chloride was successively added to 1200 mls of water in a 2 liter beaker, heated to 92° C., and treated with aqueous sodium hydroxide (50% by wt.) to a pH value of 12.5. The resultant black solid of cobalt oxide hydrate were filtered from the colorless mother liquor and washed with hot water.

Cobalt Oxide Hydrate To Cobalt Metal Powder

Reduction of the above solids at 500° C. in a hydrogen atmosphere gave 17.79 g (99% yield) of extrafine cobalt metal powder having a Fisher Sub Sieve Size value of 1.38.

Reclamation Of Cobalt In The Byproduct Streams

Byproduct streams from the above process were collected in a 2 liter beaker. Approximately 800 mls were collected as mother liquors and washes from the preparation of crude hexamminecobalt(III) chloride; about 1100 mls were collected from the preparation of pure hexamminecobalt(III) chloride. Whereas mother liquors and washes that are generated by the preparation of crude and pure hexamminecobalt(III) chloride contain sufficient cobalt to merit reclamation, the mother liquors and washes which are obtained from the preparation of cobalt oxide hydrate do not contain significant amounts of cobalt (less than 50 ppm) and do not require reclamation of cobalt values.

The mixture of mother liquors and washes contained the following concentrations of materials: 0.53 g Co/l, 1.8 g Ca/l, 0.38 g Cu/l, 1.6 g Fe/l, 0.24 g Mg/l, 0.55 g Mn/l, 2.1 g Ni/l, 33 g $NH_3$/l, and others. Successively, treating 100 mls of the mixture with sodium hydroxide to a pH value of 7.5 which precipitates iron and other ions, heating to 70° C., adding 0.1 gm of aluminum powder, stirring the hot mixture for 30 minutes, and filtering the resultant mixture through a funnel gave a blue filtrate that contained <0.05 g Co/l, 1.5 g Ca/l, <0.002 g Cu/l, <0.005 g Fe/l, 0.23 g Mg/l, 0.53 g Mn/l, 1.3 g Ni/l, 36 g $NH_3$/l, and others and a solid which contained 1 to 50% of Al, Fe, Co, Ni, Cu and other insoluble materials. A cobalt chloride solution which was suitable for the preparation of crude hexamminecobalt(III) chloride was obtained from the solids of Co, Ni, Cu, Al, Fe and other insoluble materials by adding 100 gms of the solids to 300 mls of 6N hydrochloric acid in a 1 liter beaker. The mixture was stirred for 1 hour at 80° C. Next, the pH value of the acid suspension was adjusted to 3.2 by the addition of ammonium hydroxide (28% by wt.). Filtration of the resultant hot mixture gave a filtrate which contained cobalt, copper, and nickel chlorides and solids that were composed of aluminum, iron and other insoluble salts. Approximately all of the Ca, Mg, and Mn and about 62% of the nickel that were contained in the above mixture of mother liquors and washes were separated from the insoluble cobalt by this treatment. If the mixture of mother liquor(s) and wash(es) from the preparation of crude and pure hexamminecobalt(III) chloride or from the preparation of crude hexamminecobalt(III) chloride contain greater concentrations of nickel than cobalt and the amount of aluminum that is used in the treatment is limited to the quantity that is required for the precipitation of cobalt, the resultant sludge will contain approximately one part cobalt and nickel with any excess nickel remaining in the filtrate.

Industrial Applicability

The method described and claimed herein is particularly useful in the formation of extra fine particle size cobalt powders of high purity, which is useful, for example, as a starting material in the formation of cemented carbides, e.g., tungsten carbide.

We claim:

1. An improvement in the process for producing cobalt, the basic process comprising the steps of forming cobalt ions in solution by digesting scrap tungsten carbide in hydrochloric acid to form a solution comprising cobalt chloride and dissolved cations selected from the group consisting of iron, copper, and manganese and mixtures thereof, complexing said cobalt ions with ammonia in the presence of chloride ions to form a cobalt ammine chloride solution, forming a cobalt containing precipitate, separating said cobalt containing precipitate from the resulting solution containing dissolved cations, wherein the improvement comprises contacting the resulting solution containing dissolved cations at an acid pH with a sufficient amount of aluminum metal for a sufficient period of time to form cobalt metal as a precipitate.

2. A process for producing cobalt according to claim 1 wherein the pH of the resulting solution is less than about 7.0.

3. A process for producing cobalt according to claim 2 wherein prior to complexing, said basic process comprises acidifying said cobalt ammine halide solution to form a precipitate comprising cobalt ammine halide and separating said cobalt ammine halide precipitate from the solution containing impurities and combining said solution containing impurities with the resulting solution remaining after the formation of a cobalt containing precipitate.

4. A process for producing cobalt metal powder according to claim 3 wherein said cobalt ammine halide precipitate is dissolved to form a cobalt ammine halide solution.

* * * * *